US005089094A

United States Patent [19]

Ogasawara et al.

[11] Patent Number: 5,089,094

[45] Date of Patent: Feb. 18, 1992

[54] PROCESS FOR THE ELECTROLYTIC PRODUCTION OF MAGNESIUM

[75] Inventors: Tadashi Ogasawara, Nishinomiya; Yoshitake Natsume, Kawanishi; Kenji Fujita, Nishinomiya, all of Japan

[73] Assignee: Osaka Titanium Company Limited, Amagasaki, Japan

[21] Appl. No.: 493,733

[22] Filed: Mar. 15, 1990

[30] Foreign Application Priority Data

| | | | |
|---|---|---|---|
| Mar. 16, 1989 | [JP] | Japan | 1-64289 |
| Mar. 16, 1989 | [JP] | Japan | 1-64290 |
| Apr. 17, 1989 | [JP] | Japan | 1-97014 |
| Apr. 26, 1989 | [JP] | Japan | 1-106558 |
| Aug. 23, 1989 | [JP] | Japan | 1-216927 |

[51] Int. Cl.[5] ..... C25C 3/04

[52] U.S. Cl. ..... 204/70; 204/130; 423/163; 423/178; 423/497; 423/498

[58] Field of Search ..... 204/70, 130; 423/163, 423/155, 178, 497, 478

[56] References Cited

U.S. PATENT DOCUMENTS

| | | | |
|---|---|---|---|
| 1,095,609 | 5/1914 | Kügelgen et al. | 204/130 |
| 4,115,215 | 9/1978 | Das et al. | 204/70 |
| 4,510,029 | 4/1985 | Neelameggham et al. | 204/130 |
| 4,981,674 | 1/1991 | Peacey | 423/498 |

FOREIGN PATENT DOCUMENTS

| | | | |
|---|---|---|---|
| 0380746 | 8/1973 | U.S.S.R. | 204/70 |
| 0561651 | 5/1944 | United Kingdom | 204/70 |

OTHER PUBLICATIONS

Pidgeon et al., "The Production of Anhydrous Magnesium Chloride", The Electrochemical Society, 78-20 pp. 275-295.

*Primary Examiner*—John Niebling
*Assistant Examiner*—Kathryn Gorgos
*Attorney, Agent, or Firm*—Burns, Doane, Swecker & Mathis

[57] ABSTRACT

In a process for the electrolytic production of magnesium by the molten salt electrolysis of magnesium chloride using a molten salt cell bath comprised mainly of one or more salts selected from alkali metal chlorides and alkaline earth metal chlorides, the molten salt bath is enriched with magnesium chloride by suspending a magnesium oxide and/or magnesium carbonate powder to form a molten suspension and passing a chlorine-containing gas through the molten suspension at a temperature of 600°-900° C. so as to react the suspended powder with chlorine to form magnesium chloride. The resulting molten salt enriched with magnesium chloride can be directly introduced into the cell for electrolysis, thereby eliminating moisture absorption by the highly hygroscopic magnesium chloride. A pure magnesium can be produced with a high yield and improved current efficiency.

51 Claims, 7 Drawing Sheets

PROCESS FOR THE ELECTROLYTIC PRODUCTION OF MAGNESIUM

BACKGROUND OF THE INVENTION

1. Field of the Invention

This invention relates to a process for producing pure magnesium by molten salt electrolysis of magnesium chloride. More particularly, it relates to an efficient process for the electrolytic production of magnesium in which a process for the preparation of magnesium chloride which is capable of being directly subjected to electrolysis is combined with the molten salt electrolysis process.

2. Description of the Prior Art

Magnesium (Mg) is the lightest of the commonly-used metals, and it finds a wide variety of applications, including as an alloying element with aluminum, an inoculant in the manufacture of ductile cast iron, and a reducing agent in the production of titanium from titanium tetrachloride. The consumption of magnesium is still increasing.

There are two methods which are employed in the commercial production of magnesium: the thermal reduction method in which magnesium oxide (MgO) is reduced with ferrosilicon, and the electrolytic method in which magnesium chloride ($MgCl_2$) is electrlyzed in a molten state. At present, more than 70% of magnesium is produced by the electrolytic method (C. L. Mantell, "Industrial Electrochemistry", McGraw-Hill, 1950).

Magnesium chloride for use in the electrolytic production of magnesium has been prepared by the following methods:

(1) hydrous magnesium chloride ($MgCl_2.nH_2$)) is dehydrated by heating with ammonium chloride;

(2) carnallite ($MgCl_2.KCl.6H_2O$) is decomposed and dehydrated by heating; and (3) hydrous magnesium chloride ($MgCl_2.nH_2O$) is incompletely dehydrated by dissolving it in hydrochloric acid followed by evaporation and concentration of the solution until the hydrous salt has a value for "n" in the range of 1.25–2, and it is used in the electrolysis as such (Dow method).

the above methods (1) and (2) require a great amount of energy for dehydration by heating. In addition, according to method (2), potassium chloride (KCl) formed by decomposition of carnallite is built up in the electrolytic cell and must be removed periodically.

According to the Dow method <method (3)>, since water which is present in the incompletely dehydrated salt is also electrolyzed during the molten salt electrolysis, the consumption of the graphite anode is severe and it is necessary to use a special electrolytic cell. Another disadvantage is that the gas generated in the cell has a low concentration of chlorine so that it is difficult to reuse the gas in the preparation of magnesium chloride. Furthermore, a sludge composed mainly of MgO is accumulated on the bottom of the electrolytic cell during electrolysis.

Generally, in electrowinning of a metal, when the electrolytic bath is contaminated with other metals which are nobler than the target metal to be won, the contaminant metals are deposited on the cathode prior to or simultaneously with the target metal, thereby decreasing the purity and yield of the target metal.

For example, in the electrolytic production of magnesium, the molten salt bath is frequently contaminated with iron and manganese which are nobler than magnesium, and these contaminant metals are deposited on the cathode, thereby decreasing the purity of the magnesium product. The magnesium metal deposited on the cathode is usually collected after it floats on the surface of the molten salt. If a large amount of iron is deposited along with magnesium, the resulting contaminated magnesium has a specific gravity greater than that of the molten salt and will sink to the bottom of the electrolytic cell, thereby decreasing the yield of magnesium collected by flotation.

Iron and manganese ions have more than one valence to form redox systems as shown by the following equations:

$$Fe^{3+} + e^- \rightarrow Fe^{2+} \quad (1)$$

$$Mn^{4+} + 2\,e^- \rightarrow Mn^{2+} \quad (2)$$

Therefore, the lower valence ions of a contaminant metal, e.g., $Fe^{2+}$, which are formed by reduction on the cathode move toward the anode and are oxidized thereon into the higher valence ions ($Fe^{3+}$). Thus, ions of these contaminant metals move back and forth between the electrodes to perform oxidation and reduction repeatedly, leading to wasteful consumption of electric power which decreases the current efficiency.

In solution electrolysis, an ion-exchange membrane or other diaphragm is usually located between the electrodes in order to prevent large impurity ions from moving across the diaphragm. In molten salt electrolysis, however, a diaphragm is usually not used because a suitable diaphragm material which can withstand the high-temperature and corrosive environment of the molten salt is not readily available.

Accordingly, in the production of a metal by molten salt electrolysis, it is highly advantageous that the content in the cell bath of metals which are nobler than the metal to be produced be minimized in order to improve the purity and yield of the metal and current efficiency. Thus, it is desirable that such nobler metals be previously removed from the molten salt to be subjected to electrolysis.

SUMMARY OF THE INVENTION

It is an object of the present invention to provide a process for efficiently preparing magnesium chloride which can be directly subjected to the electrolytic production of pure magnesium metal.

Another object of the invention is to provide a process for the production of pure magnesium metal by molten salt electrolysis using the magnesium chloride prepared in the above-mentioned process.

A further object of the invention is to provide a method for removing harmful iron compounds from magnesium oxide and/or magnesium carbonate which is used as a magnesium source in the above-mentioned process for preparing magnesium chloride.

A still further object of the invention is to provide a method for effectively removing metallic impurities from a molten salt bath used in the electrolytic production of magnesium in order to improve the purity and yield of the magnesium metal product and current efficiency.

According to one aspect, the present invention resides in a process for the production of magnesium by the molten salt electrolysis of magnesium chloride wherein the molten salt bath used in the electrolysis is enriched with magnesium chloride by suspending a magnesium oxide and/or magnesium carbonate powder in a molten salt comprised mainly of one or more salts selected from alkali metal chlorides and alkaline earth metal chlorides to form a molten suspension and passing a chlorine-containing gas through the molten suspension at a temperature of 600°-900° C. so as to react the suspended powder with chlorine to form magnesium chloride.

According to another aspect, the present invention provides a process for the production of magnesium by the electrolysis of magnesium chloride in a molten salt bath comprised mainly of one or more salts selected from alkali metal chlorides and alkaline earth metal chlorides. The process comprises withdrawing at least part of the molten salt bath having a decreased content of magnesium chloride from the electrolytic cell, suspending a magnesium oxide and/or magnesium carbonate powder in the withdrawn molten salt to form a molten suspension, passing a chlorine-containing gas through the molten suspension at a temperature of 600°-900° C. so as to react the suspended powder with chlorine to form magnesium chloride, and directly recycling the molten salt enriched with magnesium chloride to the electrolytic cell.

In a preferred embodiment, the magnesium oxide and/or magnesium carbonate powder is previously treated with chlorine in a molten magnesium chloride bath to remove iron impurities.

In another preferred embodiment, the molten salt to be used in the electrolysis is previously subjected to preliminary electrolysis for purification at a voltage below the decomposition voltage of magnesium chloride.

DESCRIPTION OF THE PREFERRED EMBODIMENTS

The present invention will now be described more fully with respect to a number of preferred embodiments. In the following description, all the percents are by weight unless otherwise indicated.

Figure 9A:
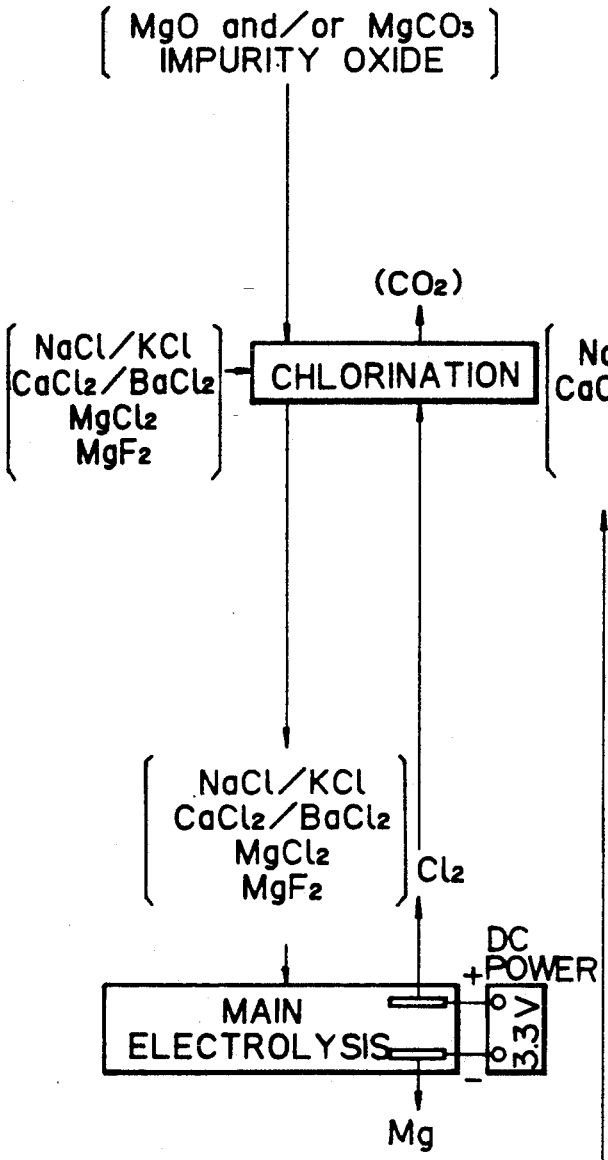
FIGS. 9*a*, 9*b*, 9*c*, and 9*d* are flow charts illustrating different embodiments of the process of the present invention.

The molten salt bath used in the electrolytic production of magnesium according to the present invention is enriched with magnesium chloride by suspending a magnesium oxide and/or magnesium carbonate powder as a magnesium source in a molten salt comprised mainly of one or more salts selected from alkali metal chlorides and alkaline earth metal chlorides and passing a chlorine-containing gas through the molten suspension so as to react the suspended powder with chlorine to form magnesium chloride, thereby increasing the magnesium chloride content of the molten salt. This step is hereinafter referred to as chlorination of the magnesium source. See FIG. 9*a*.

Useful alkali metal chlorides include sodium chloride, potassium chloride, and lithium chloride, while useful alkaline earth metal chlorides include calcium chloride, magnesium chloride, and barium chloride.

Although the molten salt bath may be comprised of a single compound, it is usually a mixture of two or more compounds selected from the above chlorides and may further comprises a minor amount of a fluoride such as magnesium fluoride so as to decrease the melting temperature of the bath and improve the conductivity thereof. Some examples of compositions of the molten salt bath which can be used in the electrolytic production of magnesium are as follows:

(a) 10-60% NaCl, 10-40% $CaCl_2$, 5-70% $MgCl_2$, less than 5% $MgF_2$;

(b) 10-60% NaCl, 10-40% $BaCl_2$, 5-70% $MgCl_2$, less than 5% $MgF_2$;

(c) 10-60% NaCl, 10-60% KCl, 10-40% $CaCl_2$, 10-60% $MgCl_2$, less than 5% $MgF_2$.

Thus, the molten salt used in the invention may comprise minor proportions of fluorides and impurities, in addition to alkali metal and/or alkaline earth metal chlorides.

A magnesium oxide and/or magnesium carbonate powder is suspended in the molten salt having a decreased content of $MgCl_2$ to form a molten suspension. The powder may be any powder containing a substantial amount of MgO or $MgCO_3$. Useful materials for the powder include magnesium oxide (MgO), magnesium carbonate ($MgCO_3$), MgO— or $MgCO_3$-containing ores such as magnesite predominantly comprising $MgCO_3$ and dolomite predominantly comprising $CaCO_3.MgCO_3$, primary products of MgO such as light burned magnesia and heavy burned magnesia, and a mixture thereof. Preferably, the magnesium oxide and/or magnesium carbonate powder has a particle size of 50-1000 μm.

The $MgCO_3$ decomposes at about 600° C. according to the following equation:

$$MgCO_3 \rightarrow MgO + CO_2 \quad (3)$$

Therefore, when $MgCO_3$ is added to a molten salt kept at a temperature above 600° C., it will decompose and form MgO, which is suspended to form a molten suspension.

Preferably, the powder has a relatively high content of MgO and/or $MgCO_3$. If the powder contains iron compounds as impurities, it is preferred that the powder be treated prior to the chlorination to remove the iron compounds.

The molten suspension is heated, if necessary, to maintain a temperature of 600°-900° C. A chlorine-containing gas is then passed through the molten suspension so that the suspended MgO reacts with chlorine to form magnesium chloride.

Preferably, the chlorine-containing gas has a high concentration of chlorine so as to make it possible to convert MgO into $MgCl_2$ efficiently. The gas may be a chlorine gas, a mixture of chlorine gas and carbon monoxide gas, or phosgene or similar gas which generates chlorine upon decomposition.

The following equations (4) and (5) show the reactions which occur in the molten suspension when a chlorine gas or a mixture of chlorine gas and carbon monoxide gas is passed through the suspension.

$$MgO+Cl_2 \rightarrow MgCl_2+\tfrac{1}{2}O_2 \quad (4)$$

$$MgO+Cl_2+CO \rightarrow MgCl_2+O_2 \quad (5)$$

A carbonaceous material may be added to either the molten suspension or the chlorine-containing gas or both. Useful carbonaceous materials include carbonaceous powders such as powders of coke and petroleum pitch, and hydrocarbon gases such as methane, ethane, and propane. The addition of a carbonaceous material causes an exothermic reaction as exemplified in the following equations (6) and (7).

$$MgO+Cl_2+\tfrac{1}{2}C \rightarrow MgCl_2+\tfrac{1}{2}CO_2 \quad (6)$$

$$4\,MgO+4\,Cl_2+CH_4 \rightarrow 4\,MgCl_2+CO_2+2\,H_2O \quad (7)$$

By passing the chlorine-containing gas through the molten salt in which MgO is suspended, the molten bath is enriched with magnesium chloride. The enriched molten salt is supplied to the electrolytic cell to constitute the cell bath in which the electrolytic production of magnesium is performed.

Figure 9B:
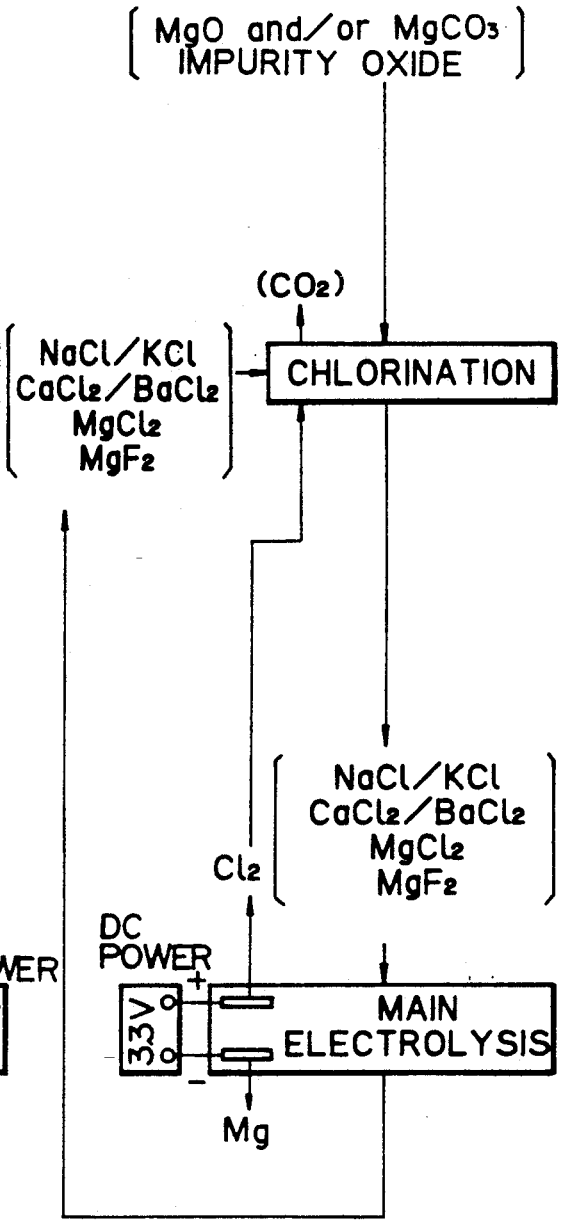

More particularly, the process of the present invention will be carried out in following manner. Also, see FIG. 9*b*.

At the start of the electrolysis in the electrolytic production of magnesium, the molten salt used to form a cell bath contains magnesium chloride in a predetermined concentration, e.g., in the range of about 20 to 50% or higher so as to attain a high current efficiency. As the electrolysis proceeds, magnesium chloride is consumed and the current efficiency is decreased, thereby decreasing the productivity.

At least a part of the molten salt bath having a decreased content (e.g., ≦20%) of magnesium chloride is withdrawn from the electrolytic cell, and it is kept at a temperature of 600°-900° C. by heating, if necessary. The above-mentioned magnesium oxide and or magnesium carbonate powder is suspended in the molten salt to form a molten suspension. A chlorine-containing gas is then passed through the molten suspension so that MgO present in the suspension reacts with $Cl_2$, thereby forming $MgCl_2$ and enriching the molten salt with $MgCl_2$. The enriched molten salt is directly recycled to the electrolytic cell to form a cell bath. Preferably, the electrolysis is carried out continuously by withdrawing a part of the molten salt.

Figure 1:
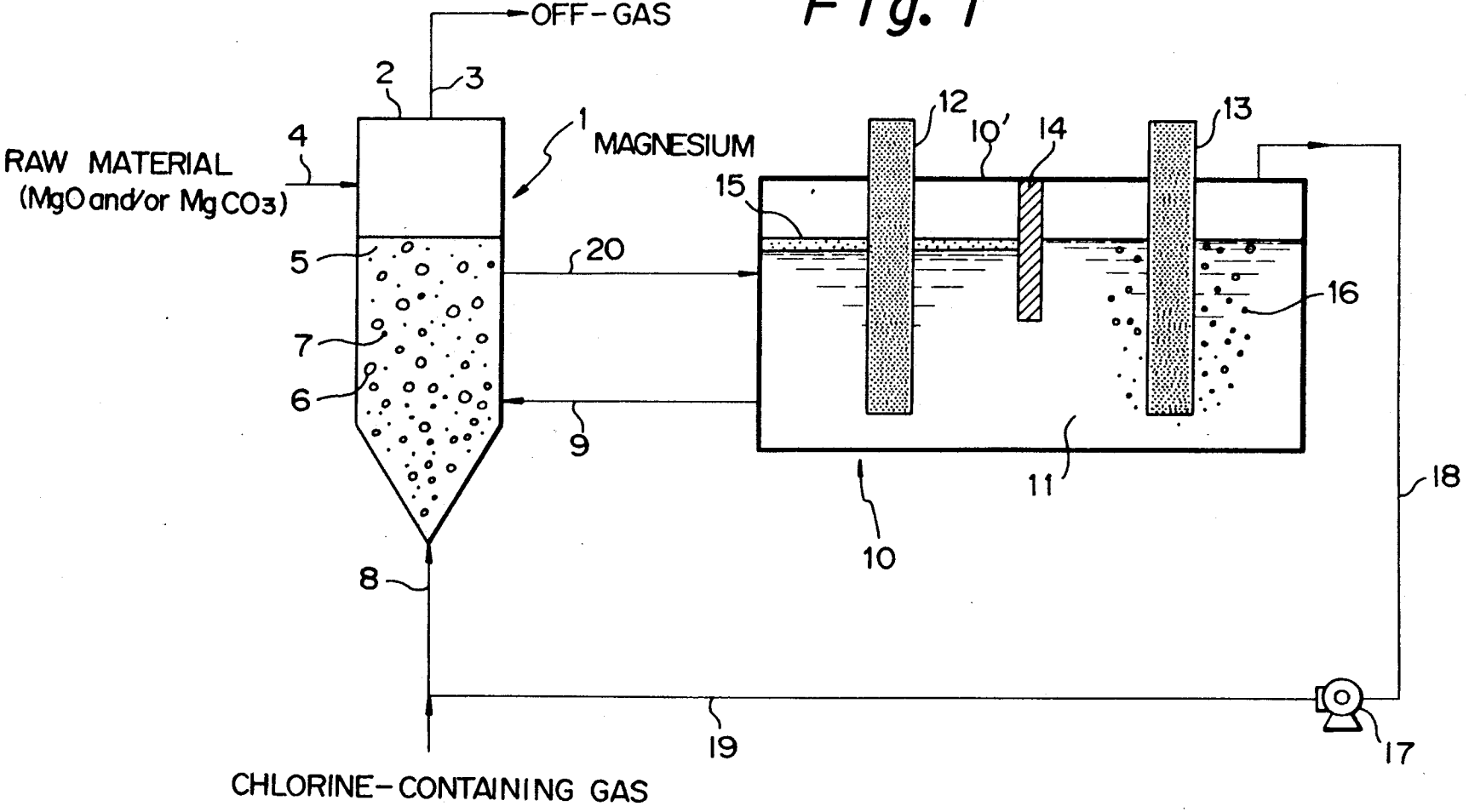
FIG. 1 is a schematic cross-sectional view of an apparatus suitable for use in the electrolytic production of magnesium according to the present invention.

FIG. 1 shows an apparatus suitable for use in the electrolytic production of magnesium according to the present invention. The apparatus comprises a chlorination furnace 1 in which the molten salt is enriched with magnesium chloride and a main electrolytic cell 10 in which the electrolysis of magnesium chloride is performed to form magnesium.

the chlorination furnace 1 and its lid 2 are made of a refractory material. A raw material inlet is formed in the upper portion of the side wall of the furnace for introducing the magnesium oxide and/or magnesium carbonate powder (hereinafter referred to as "magnesium oxide powder" for short) through a line 4. The furnace is also equipped with a gas inlet at the bottom thereof for blowing the chlorine-containing gas through a line 8. The lid 2 is equipped with a gas outlet for discharging the gas generated by the reaction along with unreacted gas from the furnace through a line 3.

The main electrolytic cell 10 and its lid 10' are also made of a refractory material. A cathode 12 and an anode 13 penetrate the lid 10' and are secured thereto. A partition 14 is placed between the cathode and anode so as to separate the cell 10 into cathode and anode chambers and prevent the chlorine gas 16 evolved on the anode from reacting with magnesium metal 15 which is deposited on the cathode and rises to the surface of the molten salt bath. The cathode 12 and anode 13 are usually made of soft iron and graphite carbon, respectively. The partition 14 is made of a refractory material such as silica, silica-alumina, zirconia, zirconia-mullite, or mullite, which is stable in the high-temperature, highly corrosive molten chloride salt bath.

In the electrolytic production of magnesium using the apparatus shown in FIG. 1, at least a part of the molten salt which constitutes a cell bath 11 of the electrolytic cell is withdrawn from the cell and transferred through a line 9 to the chlorination furnace 1 to constitute molten salt 5, which is then enriched with magnesium chloride in the furnace.

The temperature of the molten salt 5 is kept at 600°-900° C. Preferably, it is kept at 800°-900° C. so as to enhance the reactivity. Although not shown, the chlorination furnace may be equipped with a heating device. When a carbonaceous material is added to either the molten salt 5 or the chlorine-containing gas blown through the molten salt, an exothermic reaction will occur as described above and the temperature of the molten salt may be controlled by the amount of the carbonaceous material added.

Magnesium oxide powder as a raw material is introduced through a line 4 to the chlorination furnace 1 and suspended in the molten salt 5 by a suitable methods such as mechanical agitation or gas bubbling. A chlorine-containing gas passing through a gas introducing line 8 is blown through the gas inlet at the bottom of the furnace into the molten bath so as to rise therein in the form of bubbles 6 and react with magnesium oxide powder 7 suspended in the molten salt. Since the reactivity is improved as the size of the bubbles decreases, a suitable gas sparging device such as a porous disc or small nozzles is preferably attached to the gas inlet.

The magnesium oxide powder is preferably added in an amount such that the molten salt 5 has a magnesium oxide content in the range of 5-40% and more preferably 15-25%. At an MgO content of less than 5%, the rate of the chlorination reaction will decrease, and particularly when the content is less than 1% the reaction will hardly proceed. When the MgO content exceeds 40%, the viscosity of the molten salt will significantly increase and adversely affect handling of the molten salt and distribution of the chlorine-containing gas therein.

The chlorination reaction rate also tends to decrease as the content of magnesium chloride increases. This tendency is particularly pronounced when the molten salt contains more than 70% magnesium chloride. Therefore, it is also preferable that the magnesium oxide powder be added in an amount such that the magnesium chloride content of the molten salt, which is the sum of the magnesium chloride initially present in the molten salt and that formed by the chlorination reaction, does not exceed 70%.

The magnesium oxide powder 7 is reacted with chlorine to form magnesium chloride, which is dissolved in the molten salt and the molten salt is enriched with the magnesium chloride. The off-gas which comprises the gas generated by the reaction and unreacted gas is discharged from the furnace through a line 3. Since the off-gas contains unreacted chlorine, chlorine is recovered from the off-gas.

As described above, the reaction rate significantly decreases when the MgO content of the molten salt is less than 1%. It is preferable to terminate the reaction before or immediately after a significant decrease in the reaction rate of chlorine is observed by determining the concentration of unreacted chlorine gas in the off-gas, i.e., before the MgO content of the molten salt decreases to 1% or less.

The unreacted magnesium oxide powder is then allowed to settle freely toward the bottom of the furnace as sediment, and the molten supernatant is recovered for use as an electrolytic bath. The sedimented magnesium oxide powder is utilized effectively as a magnesium source in the next cycle of the chlorination reaction.

the supernatant molten salt enriched with magnesium chloride is recycled to the electrolytic cell 10 through a line 20 to constitute the cell bath 11 and is subjected to electrolysis therein. As a result of the electrolysis, chlorine gas 16 is generated at the anode 13, while magnesium 15 which is deposited on the cathode 12 floats to the surface of the molten bath in the cathode chamber and is collected as a product. The chlorine gas 16 is discharged from the cell through a line 18, pressurized by a compressor 17, and fed through lines 19 and 8 to the chlorination furnace 1 after storage in a tank, if necessary.

When an undesirable drop in current efficiency of the electrolysis is observed, a part of the molten salt with a decreased magnesium chloride content is transferred to the chlorination furnace 1 and treated with a magnesium oxide powder and a chlorine-containing gas in the above-described manner to be thereby enriched with magnesium chloride.

By repeating the above procedure, it is possible to carry out the electrolytic production of magnesium continuously. Thus, the magnesium chloride-enriched molten salt formed in the furnace 1 can be directly fed to the electrolytic cell 10, thereby preventing moisture absorption by highly hygroscopic magnesium chloride and eliminating various problems caused by moisture absorption. When the magnesium chloride-enriched molten salt is withdrawn outside the apparatus, moisture absorption may occur. In this case, the MgO sludge formed by the electrolysis in such a moist molten salt is allowed to settle as sediment to the bottom of the cell and should be removed therefrom. According to the present invention, magnesium chloride of a constant quality can be formed in an amount which corresponds to the amount consumed in the electrolysis at the desired production rate of magnesium.

When the magnesium oxide powder used as a raw material in the present invention contains various metallic impurities, all the impurities except some oxides such as silica ($SiO_2$) are also chlorinated in the chlorination step. The major impurities which may be present in the magnesium oxide raw material such as magnesia are calcium oxide (CaO) and ferric oxide ($Fe_2O_3$). Calcium oxide is chlorinated to form calcium chloride, which is harmless because it is acceptable as a constituent of the molten salt bath.

When chlorinated, ferric oxide is converted into ferric chloride ($FeCl_3$) according to the following equation:

$$Fe_2O_3 + 3\ Cl_2 \rightarrow 2\ FeCl_3 + 3/2\ O_2 \quad (8)$$

Since the decomposition temperature of ferric chloride is 314° C. and the temperature of the molten salt in the chlorination step is at least 600° C., the ferric chloride formed in the chlorination is expected to be removed from the molten salt by decomposition. However, the ferric chloride forms a double salt with sodium chloride, which is usually present in the molten salt in a considerable amount in order to improve conductivity and lower the melting temperature. Since the decomposition temperature of the resulting double salt is so high, the ferric chloride is not removed by decomposition from the molten salt at a temperature of up to 900° C. but remains therein as an impurity.

When the molten salt cell bath is contaminated with an iron compound, the purity and yield of the magnesium product and the current efficiency will be decreased, as described above. Therefore, it is highly desirable to remove any iron compound from the magnesium oxide raw material.

Figure 9C:
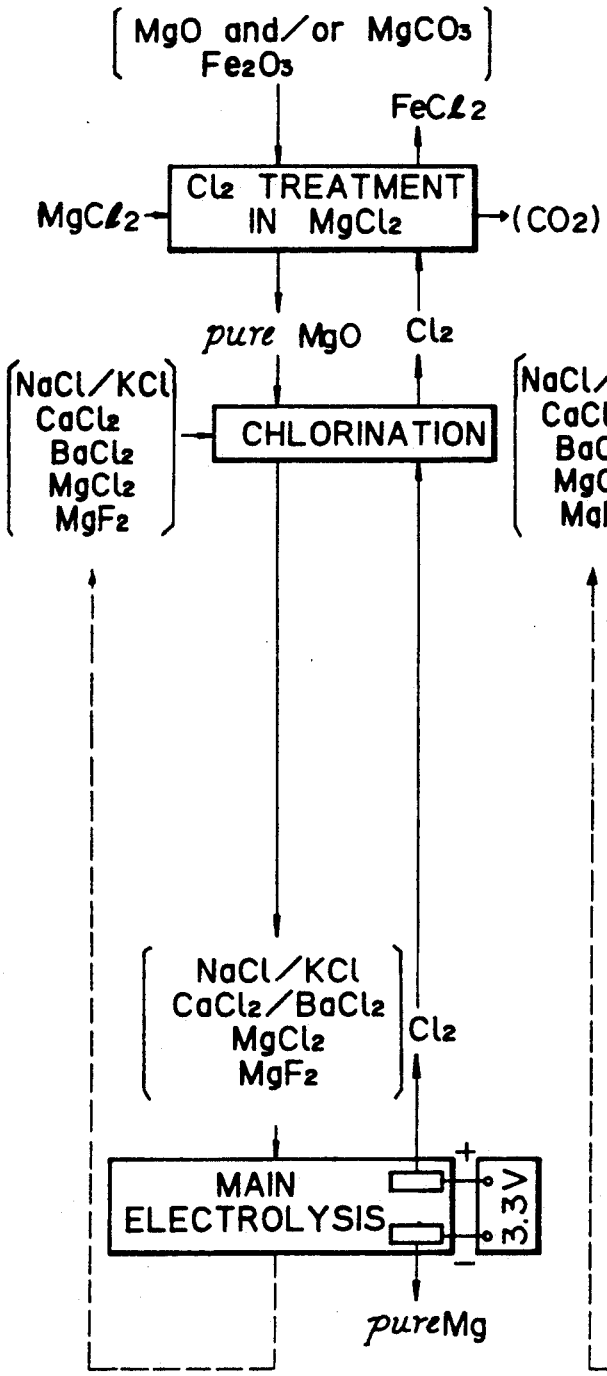

In a preferred embodiment, prior to the chlorination step, the magnesium oxide powder used as a raw material is treated with chlorine gas in a molten salt which consists essentially of magnesium chloride in order to remove iron. See FIG. 9*c*.

the chlorine gas used in the treatment may be any chlorine-containing or chlorine-generating gas and a gas similar to that used in the chlorination step may be used.

The molten salt used in the chlorine treatment consists essentially of magnesium chloride and it should not contain any compound such as sodium chloride which is capable of forming a double salt with ferric chloride having a decomposition temperature much higher than that of ferric chloride. Other compounds may be present in the molten salt in minor amounts of not greater than about 30% in total.

Magnesium chloride does not form a double salt with ferric chloride. Therefore, when the magnesium oxide powder containing ferric oxide as an impurity is suspended in a molten magnesium chloride and a chlorine gas is passed through the molten suspension, ferric chloride is formed according to equation (8) and it is readily decomposed in the sodium chloride-free molten salt and removed therefrom.

Since the molten salt comprises at least about 70% of magnesium chloride, the chlorination of magnesium oxide to form magnesium chloride does not substantially proceed, so the magnesium oxide powder from which ferric oxide has been removed remains as a suspension in the molten salt.

The chlorine treatment of the magnesium oxide powder to remove iron therefrom may be carried out in the chlorination furnace 1 described above. The chlorine treatment may be carried out in the same manner as in the chlorination step except that the molten salt 5 used consists essentially of magnesium chloride. The off-gas discharged through the line 3 comprises unreacted chlorine and decomposition products of ferric chloride. The reaction temperature is preferably 750°-900° C.

When a magnesium carbonate powder is used as a raw material, it is thermally decomposed in the molten salt to form magnesium oxide and therefore leads to the same results with respect to removal of iron content.

By the above treatment with chlorine, a suspension of magnesium oxide powder in molten magnesium chloride is obtained in which the magnesium oxide powder has a minimized iron content. The suspension is then mixed with a molten salt composed mainly of alkali metal and/or alkaline metal chlorides containing no magnesium chloride or much less than the suspension so as to lower the content of magnesium chloride in the molten salt to less than 70%. The resulting suspension in the mixed molten salt is subsequently chlorinated in the above-mentioned manner to convert magnesium oxide into magnesium chloride and is then subjected to electrolysis. Since the iron content of the molten salt electrolytic bath is minimized, it is possible to electrolytically produce magnesium of high purity with improved current efficiency.

Figure 9D:
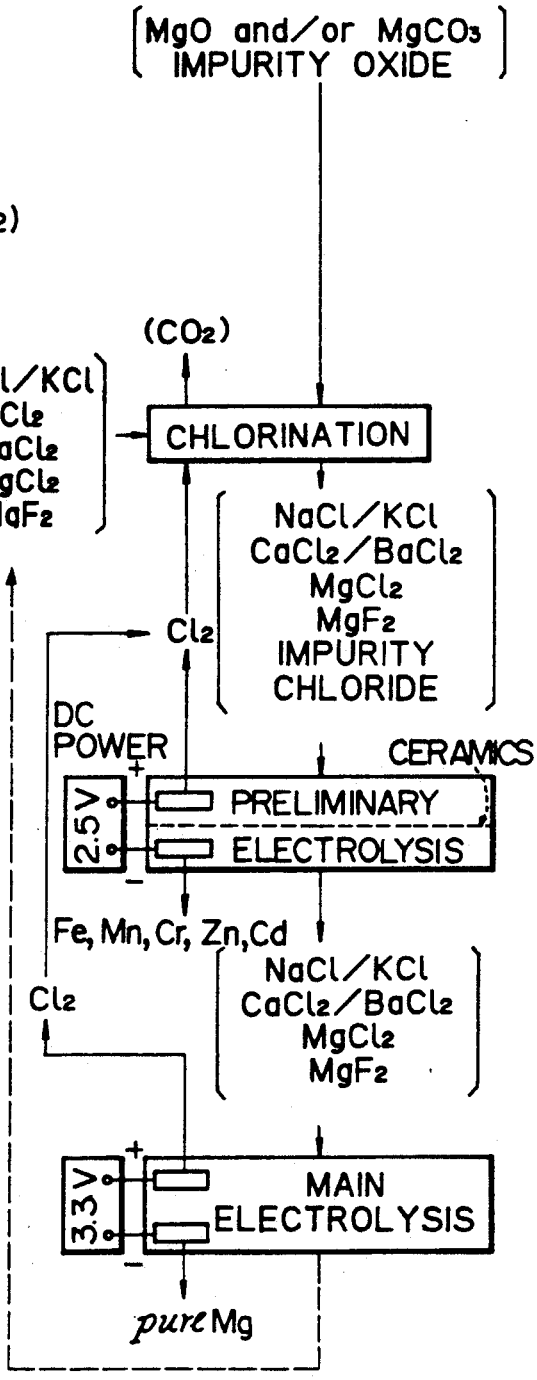

In another preferred embodiment of the present invention, the molten salt electrolytic bath which has been enriched with $MgCl_2$ in the chlorination step is purified prior to the main electrolysis by being subjected to preliminary electrolysis at a voltage lower than the decomposition voltage of magnesium chloride. By the preliminary electrolysis, harmful metallic impurities such as iron and manganese which are nobler than magnesium and which may enter the molten salt in the chlorination step are deposited on the cathode and can be removed from the electrolytic bath. See FIG. 9*d*.

Figure 2:
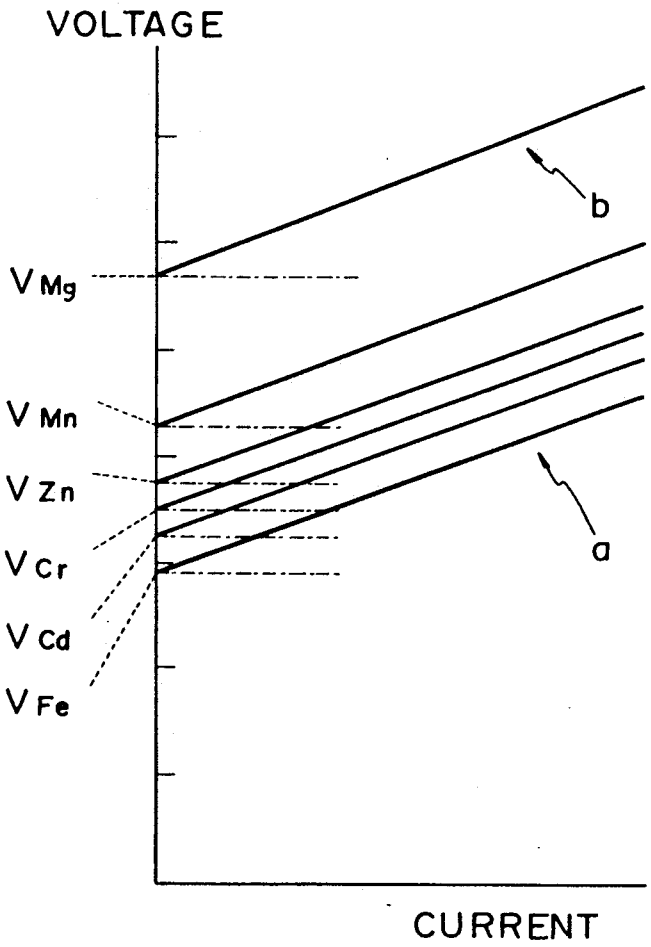
FIG. 2 is a schematic diagram showing the relationship between voltage and current in the electrolytic production of magnesium.

FIG. 2 is a schematic diagram showing the relationship between voltage and current in the electrolytic production of magnesium in which "a" and "b" show theoretical volt-ampere correlations for decomposition of ferrous chloride to deposit iron and for decomposition of magnesium chloride to deposit magnesium, respectively. The symbols $V_{Fe}$ and $V_{Mg}$ represent the decomposition voltages of ferrous chloride and magnesium chloride, respectively.

In the case of Fe deposition (line a), for example, when a voltage of $V_{Fe}+\Delta V$, which is slightly higher than $V_{Fe}$ is applied, a current of $I_{Fe}$ passes between the anode and cathode and Fe is deposited. As the applied voltage increases, a greater current passes and fe is deposited at a higher rate. When the applied voltage is lower than $V_{Mg}$, Fe can be deposited without deposition of Mg. Therefore, the preliminary electrolysis for purification of the molten electrolytic bath by removal of Fe can be carried out by applying a voltage which is higher than $V_{Fe}$ but lower than $V_{Mg}$.

Figure 3:
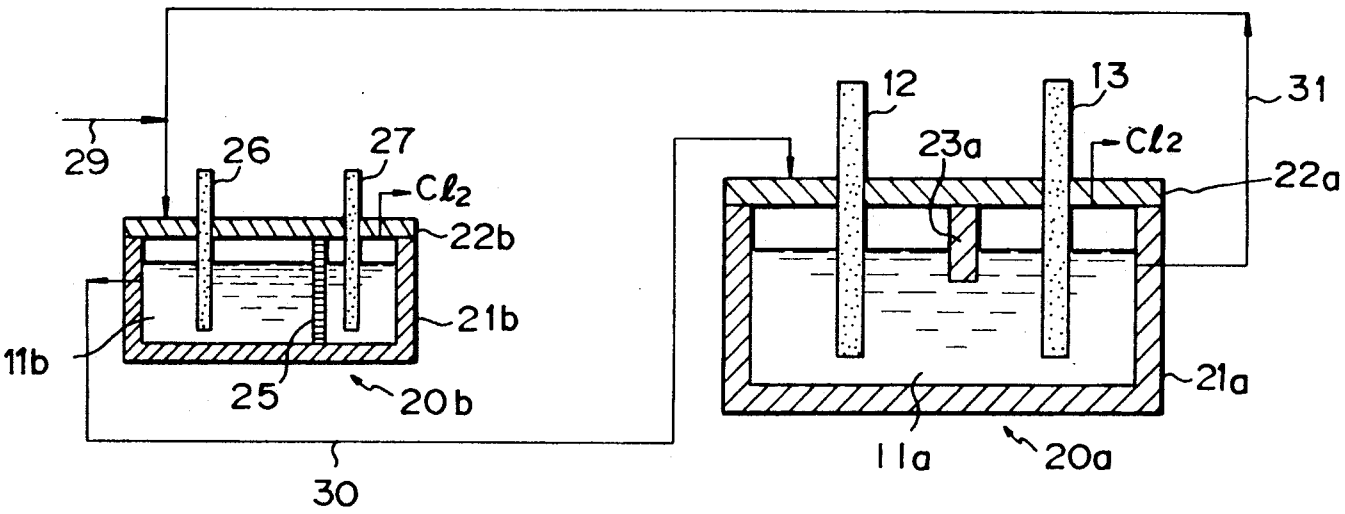
FIGS. 3 and 4 are schematic cross-sectional views of apparatuses for the electrolytic production of magnesium, each apparatus having a preliminary electrolytic cell zone for the purification of the molten salt bath.

FIG. 3 is a schematic cross-sectional view of an apparatus suitable for use in the present invention having a preliminary electrolytic cell zone for the purification of the electrolytic bath. In FIG. 3, the right-hand cell is a main electrolytic cell 20*a* and the left-hand cell is a preliminary electrolytic cell 20*b*. The main cell 20*a* is similar to the cell shown in FIG. 1 and has a cell housing 21*a*, a lid 22*a*, a cathode 12, an anode 13, and a partition 23*a*. The preliminary cell 20*b* has a cell housing 21*b* and a lid 22*b* both made of a refractory material, a porous partition 25, a cathode 26, and an anode 27. In FIG. 3, both cells are filled with molten salts to form baths 11*a* and 11*b*, respectively. The cathode 26 and anode 27 are usually made of soft iron and graphite carbon, respectively, as in the main cell. The porous partition 25 which separates the cell 20*b* into an anode and a cathode chambers is made of a refractory material such as silica, silica-alumina, zirconia, zirconia-mullite, or mullite which is stable in the corrosive molten chloride salt, and it has pores of a size sufficient to allow the molten salt 11*b* to pass therethrough, e.g., in the range of 100-500 μm. Preferably, the pore size of the porous partition is not greater than 500 μm when it is made of zirconia, mullite, or silica, and it is not greater than 200 μm when it is made of zirconia-mullite or silica-alumina.

The purification of a molten salt for use as an electrolytic bath in the electrolytic production of magnesium is carried out by introducing the molten salt through a line 29 into the preliminary cell 20*b*. The molten salt 11*b* is then subjected to preliminary electrolysis in the cell by applying a voltage between the cathode 26 and anode 27, the voltage being higher than the decomposition voltage of the metallic impurity to be removed and lower than that of magnesium chloride. The actual applied voltage may be slightly increased in view of the resistance of the molten salt. The decomposition voltage of ferrous chloride is 1-1.5 V and that of magnesium chloride is 2.5-2.9 V, so the applied voltage is preferably in the range of 1.3-2.5 V.

By the preliminary electrolysis, impurity metals such as iron, manganese, chromium, zinc, and cadmium which are nobler than magnesium can be deposited on the cathode, thereby purifying the molten salt. The cathode on which impurity metals have been deposited is replaced by a new one periodically. In this manner, impurity metals are removed from the cell. The chlorine gas evolved at the anode is discharged from the cell.

The purified molten salt 11*b* is then transferred through a line 30 to the main electrolytic cell 20*a* to constitute the electrolytic bath 11*a*, which is subjected to electrolysis (main electrolysis) at a voltage higher than the decomposition voltage of magnesium chloride to produce magnesium. The applied voltage in the main electrolysis is preferably in the range of 3-5 V.

If necessary, the molten salt 11*a* in the main cell 20*a* may be transferred through a line 31 to the preliminary cell 20*b* to purify it again. Alternatively, the molten salt may be purified by the above-mentioned treatment with chlorine gas to remove iron.

Figure 4:
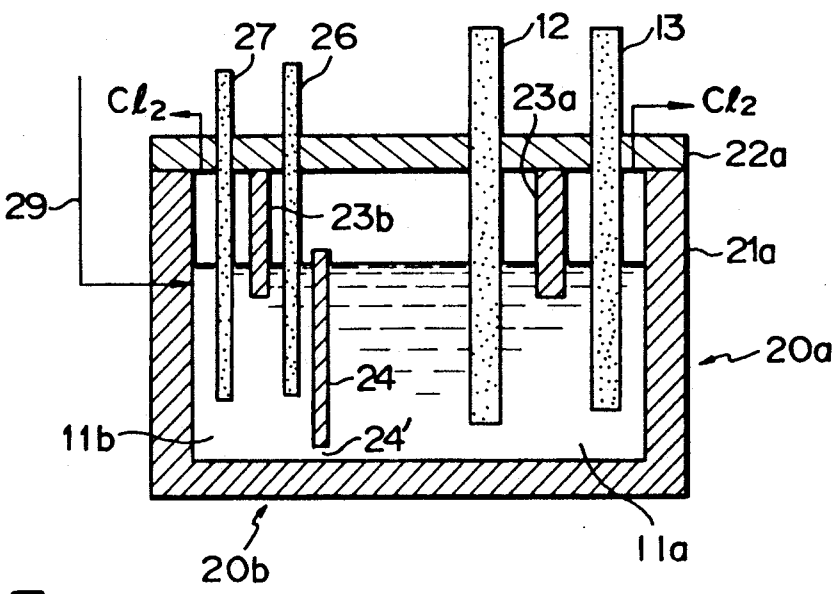

FIG. 4 is a schematic cross-sectional view of another apparatus suitable for use in the purification of the molten salt bath. The basic structure of the apparatus is the same as that of FIG. 3 except that a preliminary electrolytic cell zone 20*b* is defined within the main electrolytic cell 20*a* by a partition 24. The bottom end 24' of the partition is spaced from the bottom of the main cell so as to form an opening which permits the molten salt to flow beneath the partition. A partition 23*b* which is similar to a partition 23*a* in the main cell is located between a cathode 26 and an anode 27 in the preliminary cell zone.

During purification of the molten salt by preliminary electrolysis, impurity metals such as iron and manganese which are nobler than magnesium are deposited on the cathode as a result of reduction in the vicinity of the cathode. However, ions of these metals have more than one valence, and as the electrolysis proceeds, the lower valence ions, e.g., $Fe^{2+}$ formed by reduction in the vicinity of the cathode are forced to move toward the anode by the flow in the cell and are oxidized there into $Fe^{3+}$ ions, which are then moved back to the cathode and reduced. The repeated reduction and oxidation wastefully consume electric power.

In order to avoid such wasteful power consumption, it is preferable to separate the preliminary cell into an anode chamber and a cathode chamber by a porous partition and perform the preliminary electrolysis while creating a substantially one-way flow of the molten salt from the anode chamber to the cathode chamber through the porous partition. As a result, a movement of the molten salt from the cathode chamber to the anode chamber is substantially prevented and reduced species of impurity ions such as $Fe^{2+}$ cannot be moved toward the anode chamber, thereby eliminating the wasteful power consumption.

Figure 5:
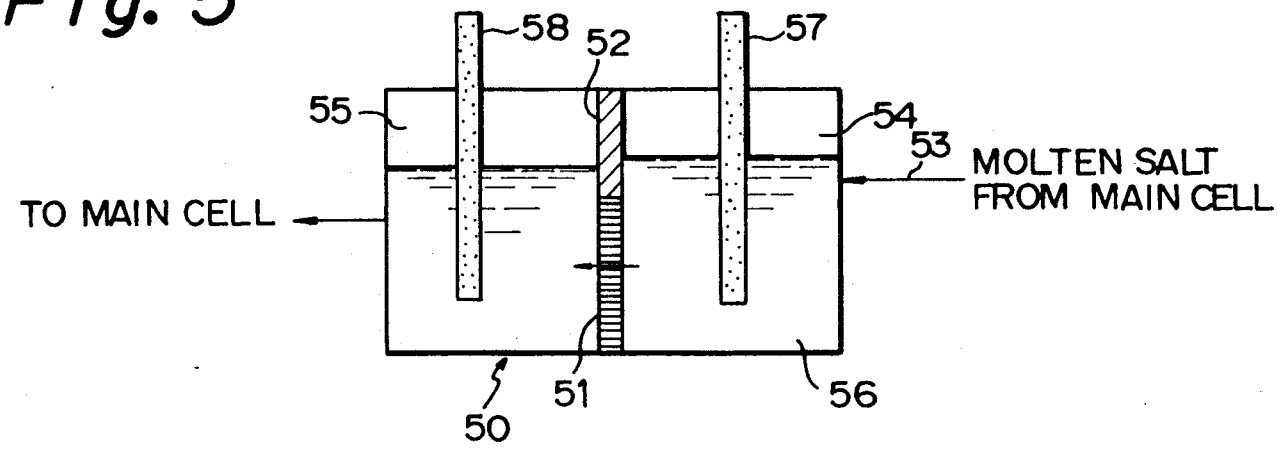
FIG. 5 is a schematic cross-sectional view of a preliminary electrolytic cell having a porous partition.
Figure 7A:
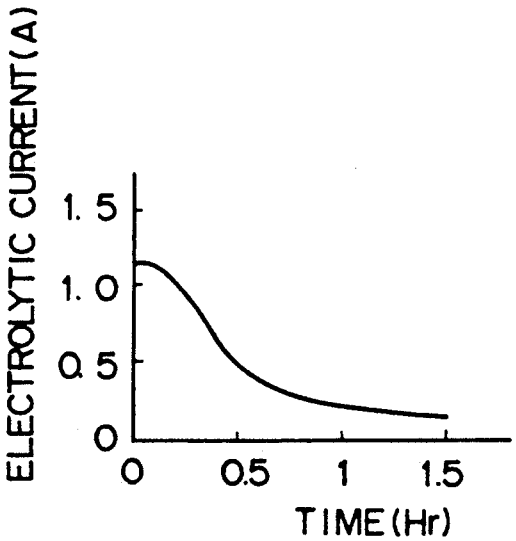
FIGS. 7*a* and 7*b* are graphs showing the change with time of current and Fe content, respectively, in a preliminary electrolysis for purification of a molten salt bath.
Figure 7B:
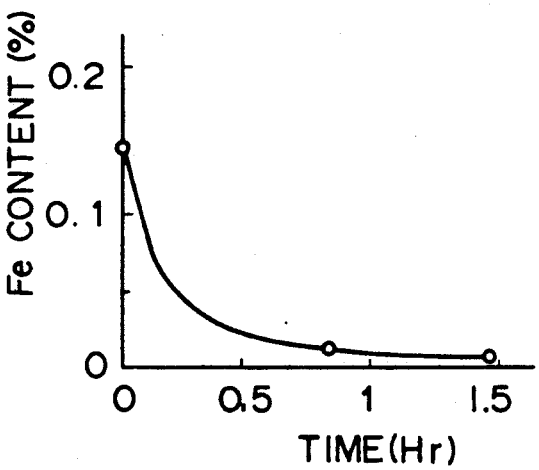

FIG. 5 schematically shows a preliminary electrolytic cell 50 having a porous partition. As shown in FIG. 5, the partition preferably consists of a lower porous panel 51 and an upper non-porous panel 52 in order to prevent the chlorine gas generated in the anode chamber from flowing to the cathode chamber. However, the entirety of the partition may be porous as shown in FIG. 3.

The purification of a molten salt in the preliminary cell 50 is performed by introducing the molten salt through a line 53 into the anode chamber 54. The molten salt 56 in the anode chamber gradually flows through the porous panel 51 into the cathode chamber 55. When the molten salt entering the cathode chamber reaches a certain level, a voltage which is lower than the decomposition voltage of magnesium chloride and higher than that of the metallic impurity to be removed is applied between the electrodes 57, 58.

The flow of the molten salt from the anode chamber to the cathode chamber can be maintained by continuously introducing the molten salt into the anode chamber and/or continuously discharging it from the cathode chamber. Alternatively, if the pore size of the porous panel is small enough to minimize the flow rate of the molten salt therethrough and the level of the molten salt in the anode chamber is sufficiently higher than that in the cathode chamber at the beginning of the preliminary electrolysis, the desired one-way flow of the molten salt toward the cathode chamber will be maintained throughout the duration of the preliminary electrolysis without continuous introduction or discharge of the molten salt.

The high-purity magnesium which is electrolytically produced by the process of the present invention can be employed in the production of titanium (Ti) by reduction of titanium tetrachloride ($TiCl_4$) according to the following equation (9):

$$TiCl_4 + 2\,Mg \rightarrow Ti + 2\,MgCl_2 \qquad (9)$$

Pure magnesium chloride is formed by a by-product in the reaction. Therefore, when an apparatus for the production of titanium is installed along with an apparatus for the electrolytic production of magnesium as shown in FIG. 1, the pure magnesium chloride obtained in the production of titanium can be used to form a molten salt in the treatment of an Fe-containing raw material with chlorine or to form a molten salt in the main electrolysis.

The following examples are given to illustrate the present invention more fully. Results of the examples are partly summarized in Tables 1 and 2.

EXAMPLE 1

An apparatus as shown in FIG. 1 was used. The chlorination furnace (inner diameter: 500 mm, height: 3500 mm) was made of silica-alumina bricks and had a porous disc secured to the gas inlet at the bottom thereof for gas distribution. The main electrolytic cell was made of silica-alumina and equipped with a cathode and an anode made of soft iron and graphite carbon, respectively, and a partition made of zirconia.

A portion (500 kg) of the molten salt bath (totally 10,000 kg) which had been subjected to electrolysis in the main cell and had a decreased content of magnesium chloride was withdrawn from the main cell and introduced into the chlorination furnace. The composition of the molten salt was approximately 15% $MgCl_2$, 50% NaCl, and 35% $CaCl_2$. The molten salt in the chlorination furnace was kept at a temperature of about 800° C. by heating with a suitable heating means (not shown), since the temperature of the molten salt bath in the main bell is usually 700° C. or below. To the molten salt, 100 kg of a magnesia powder having an MgO content of about 90% and a particle size of minus 100 mesh were added and suspended in the molten salt by blowing argon gas through the gas inlet at the bottom of the furnace. Subsequently, the gas was changed into chlorine gas, which was blown through the molten bath at a rate of 150N l/min for about 6 hours. By the reaction of magnesia and chlorine gas, the content of magnesium chloride in the molten salt was increased by 36.5%.

After the unreacted magnesia was separated by sedimentation, 600 kg of the molten salt enriched with magnesium chloride were returned to the main electrolytic cell and subjected to electrolysis at a voltage of 3.2 V. The electrolysis proceeded smoothly and efficiently while forming magnesium and chlorine gas.

After the electrolysis was continued for 6 hours, a portion (400 kg) of the molten salt bath which had a decreased content of magnesium chloride (about 15%) was again transferred to the chlorination furnace which contained about 100 kg of the remaining molten salt. The chlorination reaction could be performed satisfactorily to enrich the molten salt.

EXAMPLE 2

The procedure described in Example 1 was repeated except that 25 kg (5% based on the molten salt) of petroleum coke having a particle size of minus 200 mesh was suspended in the molten salt together with the magnesia in the chlorination step. After chlorination for 6 hours and separation of unreacted magnesia, the recovered enriched molten salt contained 38.0% of magnesium chloride. The electrolysis to form magnesium and chlorine gas in the enriched molten salt proceeded smoothly.

EXAMPLE 3

The procedure described in Example 1 was repeated except that the gas blown through the molten salt in the chlorination furnace was a 1:1 mixture of chlorine gas and carbon monoxide gas. After chlorination for 6 hours and separation of unreacted magnesia, the recovered enriched molten salt contained 40.0% of magnesium chloride. The electrolysis to form magnesium and chlorine gas in the enriched molten salt proceeded smoothly.

EXAMPLE 4

The procedure described in Example 1 was repeated except that 100 kg of magnesium carbonate were used in place of magnesia, and the chlorination reaction was continued for about 9 hours. When magnesium carbonate was added to the molten salt, numerous gas bubbles were formed and the molten salt turned black. The molten salt, however, again became clear shortly after the blowing of the chlorine gas was started. After chlorination for about 9 hours and separation of unreacted magnesia, the recovered enriched molten salt contained 29.5% of magnesium chloride. The electrolysis to form magnesium and chlorine gas in the enriched molten salt proceeded smoothly.

EXAMPLE 5

Following the procedure described in Example 1, the electrolytic production of magnesium was continued for 3 months while the current passed through the cell and the intervals at which the molten salt was withdrawn for enrichment by chlorination were adjusted in such a manner that the amount of magnesium chloride consumed by electrolysis was equal to that formed by the chlorination. More particularly, the electrolysis was performed continuously and the chlorination was carried out intermittently. When the incremental increase in magnesium chloride obtained by the latest cycle of chlorination was consumed by the electrolysis, a part of the electrolytic bath was withdrawn, enriched by chlorination and returned to the cell.

Compared to the conventional procedure in which magnesium chloride is added to the cell in the form of solid powder, the current efficiency increased by about 2%, and the amount of sludge accumulated on the bottom of the cell caused by sedimentation of magnesium oxide decreased by 35% during the 3-month continuous electrolysis. It is believed that the increased current efficiency and reduced sludge were attributable to the fact that, according to the present invention, highly hygroscopic magnesium chloride formed in the chlorination was introduced directly into the cell in a molten state without exposure to the atmosphere.

EXAMPLE 6

The procedure described in Example 1 was repeated except that the porous disc at the gas inlet of the chlorination furnace was detached. The chlorination reaction required 8 hours until the content of magnesium chloride in the molten salt in the furnace was increased to 41%. Thus, the use of a porous disc at the gas inlet accelerated the chlorination reaction.

EXAMPLE 7-9

A molten salt having the same composition as in Example 1 was enriched by the chlorination reaction of magnesia in the same manner as described in Examples 1 to 3 except that the chlorine gas was blown for 7.5 hours. The content of magnesium chloride in the resulting enriched molten salt was 41%, 43%, and 47%, respectively.

EXAMPLES 10-15

The chlorination was carried out in the same manner as described in Examples 7-9 except that the temperature of the molten salt was decreased to 700° C. or 650° C. The conditions for the chlorination reaction and the results are summarized in Table 1.

As can be seen from Table 1, as the temperature decreased, the increase in reaction rate attained by addition of a carbonaceous material became more significant.

EXAMPLE 16

The chlorination furnace described in Example 1 was charged with 300 kg of molten magnesium chloride at 800° C. After 200 kg of magnesia powder containing 91.0% MgO and 0.68% $Fe_2O_3$ and having a particle size of minus 100 mesh were suspended in the molten salt, chlorine gas was blown through the molten suspension at a flow rate of 100N l/min.

Figure 6:
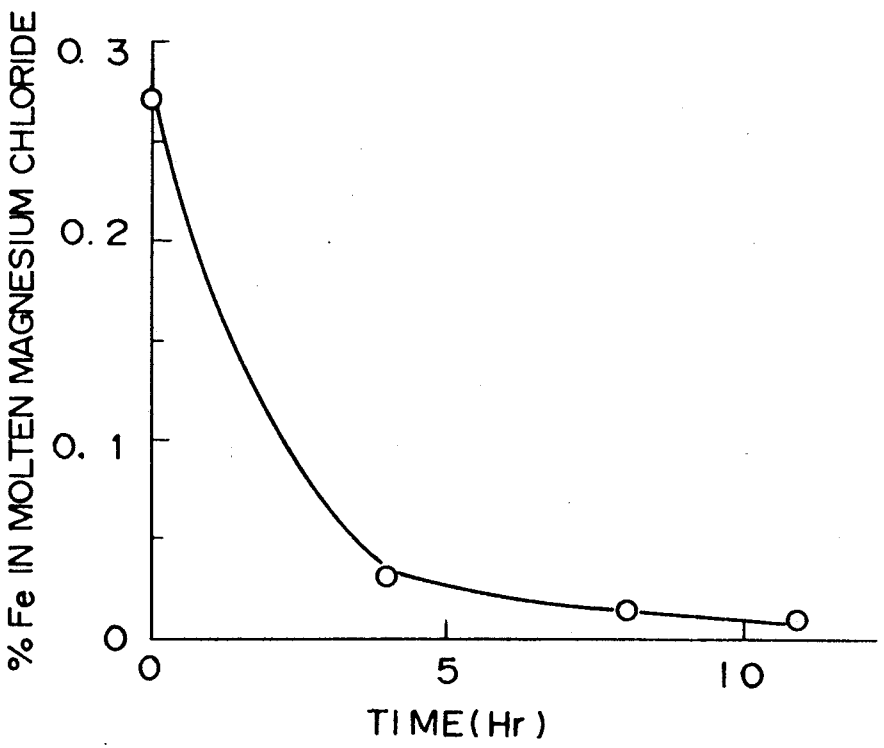
FIG. 6 is a graph showing the change of Fe content with time in a molten magnesium chloride bath when magnesia is treated with chlorine in the molten magnesium chloride bath to remove iron.

FIG. 6 shows the change with time of the Fe content in the molten suspension during the treatment with chlorine gas. After the treatment with chlorine gas for 11 hours, the initial Fe content of 0.27% decreased to 0.005%.

A portion (100 kg) of the treated molten suspension containing magnesia powder having a minimized Fe content in a molten magnesium chloride was mixed with 300 kg of sodium chloride and 100 kg of calcium chloride to form a molten salt mixture containing 13% magnesium chloride. The molten salt mixture was then subjected to the chlorination reaction at 800° C. by blowing chlorine gas at a flow rate of 150N l/min for 3 hours in the same manner as described in Example 1. The content of magnesium chloride in the mixture was increased to 26% and the content of ferric chloride was less than 20 ppm.

After the unreacted magnesia was separated by sedimentation, 450 kg of the enriched molten salt mixture were added to the electrolytic cell and subjected to electrolysis at a voltage of 3.2 V. The Fe content of the magnesium obtained in the electrolysis was less than 20 ppm.

For comparison, 100 kg of untreated magnesia were mixed with 100 kg of magnesium chloride, 200 kg of sodium chloride, and 100 kg of calcium chloride to form a molten salt mixture, and the mixture was then subjected to chlorination under the same conditions as above. The molten salt mixture contained 0.22% ferric chloride. After the unreacted magnesia was separated, the enriched molten salt mixture was subjected to electrolysis in the same manner as above. The magnesium recovered in the initial stage of electrolysis contained 200 ppm of Fe.

TABLE 1

| Conditions and Results in the Chlorination Step | | | | | | |
|---|---|---|---|---|---|---|
| | Molten salt introduced into chlorination furnace | | Temp. of molten | Mg source/ amount add- | Gas blown into furnace | |
| Example No. | Composition (wt %) | Amount (kg) | salt in furnace | ed to fur- nace (kg) | Composition (mole %) | Rate (Nl/min) |
| 1 | 15% $MgCl_2$, 50% NaCl, 35% $CaCl_2$ | 500 | 800° C. | MgO[1)]/100 | 100% $Cl_2$ | 150 |
| 2 | 15% $MgCl_2$, 50% NaCl, 35% $CaCl_2$ | " | " | " | " | " |

TABLE 1-continued

| Conditions and Results in the Chlorination Step | | | | | | |
|---|---|---|---|---|---|---|
| 3 | 15% $MgCl_2$, 50% NaCl, 35% $CaCl_2$ | " | " | " | 50% $Cl_2$, 50% CO | " |
| 4 | 15% $MgCl_2$, 50% NaCl, 35% $CaCl_2$ | " | " | $MgCO_3$/100 | 100% $Cl_2$ | " |
| 5 | 15% $MgCl_2$, 50% NaCl, 35% $CaCl_2$ | " | " | MgO[1)]/100 | " | " |
| 6 | 15% $MgCl_2$, 50% NaCl, 35% $CaCl_2$ | " | " | " | " | " |
| 7 | 15% $MgCl_2$, 50% NaCl, 35% $CaCl_2$ | " | " | " | " | " |
| 8 | 15% $MgCl_2$, 50% NaCl, 35% $CaCl_2$ | " | " | " | " | " |
| 9 | 15% $MgCl_2$, 50% NaCl, 35% $CaCl_2$ | " | " | " | 50% $Cl_2$, 50% CO | " |
| 10 | 15% $MgCl_2$, 50% NaCl, 35% $CaCl_2$ | " | 700° C. | " | 100% $Cl_2$ | " |
| 11 | 15% $MgCl_2$, 50% NaCl, 35% $CaCl_2$ | " | " | " | " | " |
| 12 | 15% $MgCl_2$, 50% NaCl, 35% $CaCl_2$ | " | " | " | 50% $Cl_2$, 50% CO | " |
| 13 | 15% $MgCl_2$, 50% NaCl, 35% $CaCl_2$ | " | 650° C. | " | 100% $Cl_2$ | " |
| 14 | 15% $MgCl_2$, 50% NaCl, 35% $CaCl_2$ | " | " | " | " | " |
| 15 | 15% $MgCl_2$, 50% NaCl, 35% $CaCl_2$ | " | " | " | 50% $Cl_2$, 50% CO | " |
| 16 | 13% $MgCl_2$, 65% NaCl, 22% $CaCl_2$ | 460 | 800° C. | MgO[2)]/40 | 100% $Cl_2$ | " |

| Example No. | Blowing Period (hrs) | Porous disc at gas inlet | Amount of petroleum coke added to furnace (wt %) | Conc. of $MgCl_2$ in molten salt after chlorination (wt %) | Ratio of reaction rate |
|---|---|---|---|---|---|
| 1 | 6 | Used | 0 | 36.5 | |
| 2 | " | " | 5 | 38.0 | |
| 3 | " | " | 0 | 40.0 | |
| 4 | 9 | " | " | 29.5 | |
| 5 | 6 | " | " | 36.5 | |
| 6 | 8 | None | " | 41 | |
| 7 | 7.5 | Used | " | 41 | |
| 8 | " | " | 5 | 43 | |
| 9 | " | " | 0 | 47 | |
| 10 | " | " | " | | 1 |
| 11 | " | " | 5 | | 1.2 |
| 12 | " | " | 0 | | 1.4 |
| 13 | " | " | " | | 0.5 |
| 14 | " | " | 5 | | 0.7 |
| 15 | " | " | 0 | | 1.3 |
| 16 | 3 | " | " | 26 | |

[1)]MgO content: 94%, particle size: minus 100 mesh;
[2)]MgO content: 91%, $Fe_2O_3$ content: 0.68%, particle size: minus 100 mesh.

EXAMPLE 17

.The preliminary cell **20*b* in an apparatus as shown in FIG. 3** was charged with 1700 kg of a molten salt mixture (20% $MgCl_2$, 50% NaCl, and 30% $CaCl_2$) containing ferric chloride in an amount of 0.15% as Fe. The level of the molten bath was the same between the anode and cathode chambers and the temperature of the molten salt bath was kept at 700° C. A direct current was passed between the electrodes at a voltage of 2.5 V for preliminary electrolysis. Metallic iron was deposited on the cathode while chlorine gas was generated at the anode. After the preliminary electrolysis for 1.5 hours, the molten salt bath was purified to a degree that the Fe content was less than 30 ppm.

The preliminary cell was made of silica-alumina and had a porous partition of zirconia with a pore size of 500 μm, a graphite anode, and an iron cathode.

FIGS. **7*a* and 7*b*** show the changes with time of electrolytic current passed and Fe content of the molten salt, respectively, in the preliminary electrolysis. The electrolytic current served mainly to deposit iron at the cathode. It can be seen from these figures that the Fe content decreased as the electrolytic current decreased.

The purified molten salt bath was then transferred to the main cell **20*a*** and subjected to main electrolysis at a voltage of 3.3 V. The magnesium recovered from the cell had an Fe content of less than 30 ppm.

For comparison, the molten salt mixture containing ferric chloride was directly introduced into the main cell without preliminary electrolysis and subjected to main electrolysis under the same conditions as above. The magnesium recovered at the initial stage of electrolysis contained 200 ppm of Fe.

EXAMPLE 18

The preliminary electrolysis was performed in the same manner as described in Example 17 except that the molten salt mixture contained 0.15% as Fe of ferric chloride and 0.1% as Mn of manganese chloride. Metallic iron and manganese were deposited on the cathode, while chlorine gas was generated at the anode. After the preliminary electrolysis for about 2 hours, a purified molten salt mixture having an Fe content and an Mn content of less than 30 ppm each was obtained.

Figure 8A:
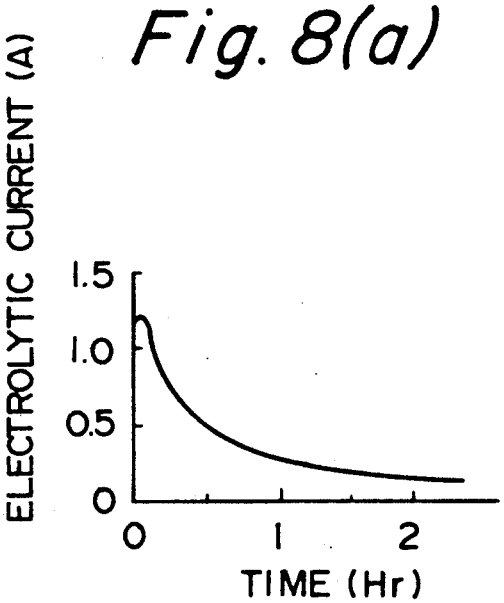
FIGS. 8*a* and 8*b* are graphs showing the change with time of current and Fe and Mn contents, respectively, in a preliminary electrolysis for purification of a molten salt bath.
Figure 8B:
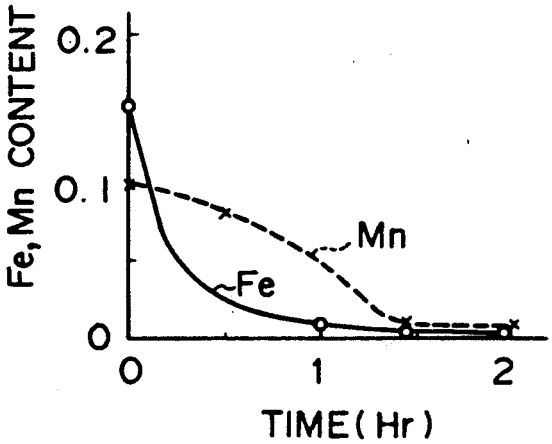

FIGS. 8*a* and 8*b* show the changes with time in the electrolytic current and the content of Fe and Mn in the molten salt, respectively, in the preliminary electrolysis. It can be seen from these figures that both the Fe and Mn content decreased as the electrolytic current decreased.

The purified molten salt mixture was then transferred to the main cell and subjected to main electrolysis at a voltage of 3.3 V. The magnesium recovered from the cell had an Fe content and an Mn content of less than 30 ppm each.

For comparison, the molten salt mixture containing ferric chloride and manganese chloride was directly introduced into the main cell without preliminary electrolysis and subjected to main electrolysis under the same conditions as above. The magnesium recovered at the initial stage of electrolysis contained 200 ppm of Fe and 130 ppm of Mn.

EXAMPLES 19-21 the preliminary electrolysis was performed in the same manner as described in Example 17 except that the molten salt mixture initially contained 0.1% of a metallic impurity in the form of chromium chloride, zinc chloride, or cadmium chloride. After the preliminary electrolysis for 1.5 hours, a purified molten salt mixture having a Cr, Zn, or Cd content of less than 30 ppm was obtained.

The purified molten salt mixture was then transferred to the main cell and subjected to main electrolysis at a voltage of 3.3 V. The magnesium recovered from the cell had a Cr, Zn, or Cd content of less than 30 ppm.

The results on purification of the molten salt bath by the preliminary electrolysis in Examples 17-21 are summarized in Table 2.

TABLE 2

| Example No. | % Impurity metal in molten salt introduced into preliminary cell | Impurity metal content in Mg produced recovered from main electrolysis |
|---|---|---|
| 17 | Fe 0.15% | This Invention<br>Fe ≦ 30 ppm<br>Comparative<br>Fe 200 ppm |
| 18 | Fe 0.15%, Mn 0.1% | This Invention<br>Fe ≦ 30 ppm, Mn ≦ 30 ppm<br>Comparative<br>Fe 200 ppm, Mn 130 ppm |
| 19 | Cr 0.1% | Cr ≦ 30 ppm |
| 20 | Zn 0.1% | Zn ≦ 30 ppm |
| 21 | Cd 0.1% | Cd ≦ 30 ppm |

EXAMPLE 22

A preliminary cell as shown in FIG. 5 which was made of a quartz cell measuring 25 cm (length)×10 cm (width)×20 cm (height) and having a 10 mm-thick porous partition made of a zirconia (pore size: 200 μm) to separate the cell into an anode and a cathode chamber was charged with 6 kg of a salt mixture consisting of 20% magnesium chloride, 50% sodium chloride, and 30% calcium chloride. The mixture was melted by heating at 700° C. and kept at that temperature. The molten mixture had an Fe content of less than 30 ppm.

Subsequently, a molten salt mixture having the same composition as above and containing 1% as Fe of ferric chloride was continuously introduced into the anode chamber at a rate of 60 g/min. Iron ions were initially present solely in the anode chamber, but as the flow of the molten salt through the porous partition into the cathode chamber continued, they moved toward the cathode chamber and entered it. After 15 minutes, the Fe content of the molten salt in the anode chamber was 0.2%, while that in the cathode chamber was 0.05%.

At that time, a direct current was passed between the electrodes at a voltage 2.5 V to perform preliminary electrolysis for purification. Initially, a current of 3 A passed but it gradually dropped to 0.8 A and thereafter became almost constant at 0.8 A. Under these constant conditions, the current efficiency was 60%. Although the quantity of electricity should be greater than the equivalent amount of iron ions entering the cathode chamber, due to the low concentration of iron ions, only the current corresponding to the amount of entering iron ions passed. About 15 minutes after the start of the preliminary electrolysis, a continuous discharge of the molten salt in the cathode chamber was started. The discharged molten salt had an Fe content of less than 30 ppm. Thus, it was purified to a satisfactory degree.

EXAMPLE 23

The preliminary electrolysis was performed in the same manner as described in Example 22 except that a 10 mm-thick porous partition made of zirconia-mullite (pore size: 200 μm) was used.

The molten salt discharged from the cathode chamber had an Fe content of less than 30 ppm.

EXAMPLE 24

The preliminary electrolysis was performed in the same manner as described in Example 22 except that the partition was made of a 10 mm-thick mullite panel having 100 pores with a diameter of 500 μm.

The molten salt discharged from the cathode chamber had an Fe content of less than 30 ppm.

EXAMPLE 25

The preliminary electrolysis was performed in the same manner as described in Example 22 except that the molten salt mixture continuously introduced into the anode chamber contained 1% as Mn of manganese chloride in addition to the ferric chloride.

The molten salt discharged from the cathode chamber had an Fe content and Mn content of less than 30 ppm each. The current efficiency was 50%.

Although the invention has been described with respect to preferred embodiments, it is to be understood that variations and modifications may be employed without departing from the concept of the invention as defined in the following claims.

What is claimed is:

1. A process for preparing a magnesium chloride containing salt bath which can be used in the production of magnesium by molten salt electrolysis of magnesium chloride, comprising the steps of:

suspending a magnesium oxide or magnesium carbonate or magnesium oxide and magnesium carbonate powder in a molten salt comprised mainly of one or more salts selected from alkali metal chlorides and alkaline earth metal chlorides to form a molten suspension having a magnesium oxide content in the range of 5-40 wt. %; and passing a chlorine-containing gas through the molten suspension at a temperature of 600°-900° C. so as to react the suspended powder with chlorine to form magnesium chloride in a magnesium chloride enriched salt bath.

2. The process according to claim 1, wherein the chlorine-containing gas consists essentially of chlorine gas.

3. The process according to claim 1, wherein the chlorine-containing gas is a mixture of chlorine gas and carbon monoxide gas.

4. The process according to claim 1, wherein a carbonaceous material is added to either the chlorine-containing gas or the molten salt or both.

5. The process according to claim 1, further comprising a purification step wherein the magnesium oxide or magnesium carbonate or magnesium oxide and magnesium carbonate powder is treated, prior to suspending the powder in the molten salt, with chlorine in a pretreatment molten bath consisting essentially of magnesium chloride to remove iron compounds.

6. The process according to claim 5, wherein after the purification step, the one or more salts are added to the pretreatment bath to form the molten suspension.

7. The process according to claim 5, wherein said molten salt comprises at least about 70 wt. % of magnesium chloride, and does not contain any compound which forms a double salt with ferric chloride having a decomposition temperature higher than that of ferric chloride.

8. The process according to claim 1, further comprising purifying the magnesium chloride enriched salt bath by subjecting the magnesium chloride enriched salt bath to preliminary electrolysis for purification at a voltage below the decomposition voltage of magnesium chloride.

9. The process according to claim 8, wherein the preliminary electrolysis is performed in a cell having an anode chamber and a cathode chamber separated by a porous partition while creating a substantially one-way flow of the magnesium chloride enriched salt bath from the anode chamber to the cathode chamber through the porous partition.

10. The process according to claim 9, wherein the porous partition is made of zirconia, mullite, or silica.

11. The process according to claim 10, wherein the porous partition has pores of not greater than 500 μm in diameter.

12. The process according to claim 9, wherein the porous partition is made of a zirconia-mullite or silica-alumina ceramic material.

13. The process according to claim 12, wherein the porous partition has pores of not greater than 200 μm in diameter.

14. The process according to claim 6, wherein the voltage in said preliminary electrolysis step is in the range of 1.3–2.5 V.

15. The process according to claim 1, wherein the molten salt bath contains one or more salts other than magnesium chloride, the magnesium chloride content of said molten salt not exceeding 70 wt. %.

16. The process according to claim 1, wherein the chlorination step is terminated before the magnesium oxide content of said molten salt decreases to 1 wt. % or less.

17. A process for the electrolytic production of magnesium comprising:

producing magnesium in an electrolytic cell by electrolysis of magnesium chloride in a molten salt bath comprised mainly of one or more salts selected from alkali metal chlorides and alkaline earth metal chlorides;

withdrawing at least part of the molten salt bath having a decreased content of magnesium chloride from the electrolytic cell;

suspending a magnesium oxide or magnesium carbonate or magnesium oxide and magnesium carbonate powder in the withdrawn molten salt to form a molten suspension having a magnesium oxide content in the range of 5–40 wt. %;

passing a chlorine-containing gas through the molten suspension at a temperature of 600°–900° C. and reacting the suspended powder with chlorine to form magnesium chloride in a magnesium chloride enriched salt bath; and recycling the magnesium chloride enriched salt bath to the electrolytic cell without atmospheric exposure of the magnesium chloride enriched salt bath.

18. The process according to claim 17, wherein the chlorine-containing gas consists essentially of chlorine gas.

19. The process according to claim 17, wherein the chlorine-containing gas is a mixture of chlorine gas and carbon monoxide gas.

20. The process according to claim 17, wherein a carbonaceous material is added to either the chlorine-containing gas or the molten salt or both.

21. The process according to claim 17, wherein the magnesium oxide or magnesium carbonate or magnesium oxide and magnesium carbonate powder is treated, prior to suspending the powder in the molten salt, with chlorine in a pretreatment molten bath consisting essentially of magnesium chloride to remove iron compounds.

22. The process according to claim 21, wherein after the purification step, the one or more salts are added to the pretreatment molten bath to form the molten suspension.

23. The process according to claim 21, wherein said molten salt comprises at least about 70 wt. % of magnesium chloride, and does not contain any compound which forms a double salt with ferric chloride having a decomposition temperature higher than that of ferric chloride.

24. The process according to claim 17, wherein prior to recycling the magnesium chloride enriched salt bath to the electrolytic cell, the magnesium chloride enriched salt bath is subjected to preliminary electrolysis for purification at a voltage below the decomposition voltage of magnesium chloride.

25. The process according to claim 24, wherein the preliminary electrolysis is performed in a cell having an anode chamber and a cathode chamber separated by a porous partition while creating a substantially one-way flow of the magnesium chloride enriched salt bath from the anode chamber to the cathode chamber through the porous partition.

26. The process according to claim 25, wherein the porous partition is made of zirconia, mullite, or silica.

27. The process according to claim 26, wherein the porous partition has pores of not greater than 500 μm in diameter.

28. The process according to claim 25, wherein the porous partition is made of a zirconia-mullite or silica-alumina ceramic material;

29. The process according to claim 28, wherein the porous partition has pores of not greater than 200 μm in diameter.

30. The process according to claim 24, wherein the voltage in said preliminary electrolysis step is in the range of 1.3–2.5 V.

31. The process according to claim 17, wherein the molten salt bath contains one or more salts other than magnesium chloride, the magnesium chloride content of said molten salt not exceeding 70 wt. %.

32. The process according to claim 17, wherein the chlorination step is terminated before the magnesium oxide content of said molten salt decreases to 1 wt. % or less.

33. A process for producing cell feed containing magnesium chloride, comprising the steps of:

(i) preparing a carbonaceous-free molten salt consisting essentially of alkali metal chloride and alkali earth metal chloride;

(ii) preparing a powder of magnesium oxide or magnesium carbonate or a mixture thereof;

(iii) suspending said powder in said molten salt to form a molten suspension free of carbon other than the magnesium carbonate if added in step (ii); and (iv) passing chlorine gas in said molten suspension at a temperature above 600° C. and below 900° C., so as to react the suspended powder with chlorine and form magnesium chloride in a magnesium chloride enriched salt bath free of carbon other than the magnesium carbonate if added in step (ii).

34. The process according to claim 33, further comprising a step of pretreating said powder prior to step (iii) by suspending said powder with chlorine gas in molten magnesium chloride so as to remove iron compounds.

35. The process according to claim 34, wherein step (i) is performed by adding the alkali metal chloride and alkali earth metal chloride to the molten magnesium chloride, after the pretreating step.

36. The process according to claim 34, wherein said molten salt comprises at least about 70 wt. % of magnesium chloride, and does not contain any compound which forms a double salt with ferric chloride having a decomposition temperature higher than that of ferric chloride.

37. The process according to claim 33, further comprising a step of subjecting said magnesium chloride enriched salt bath to preliminary electrolysis in a cell at a voltage below the decomposition voltage of magnesium chloride, said cell having an anode chamber and a cathode chamber separated by a porous partition, and said magnesium chloride enriched salt bath flowing substantially one-way from the anode chamber to the cathode chamber through said porous partition.

38. The process according to claim 31, wherein the porous partition is made of zirconia, mullite, or silica.

39. The process according to claim 38, wherein the porous partition has pores of not greater than 500 μm in diameter.

40. The process according to claim 39, wherein the porous partition has pores of not greater than 200 μm in diameter.

41. The process according to claim 31, wherein the porous partition is made of a zirconia-mullite or silica-alumina ceramic material.

42. The process according to claim 31, wherein the voltage in said preliminary electrolysis step is in the range of 1.3–2.5 V.

43. The process according to claim 33, further comprising steps of:

supplying molten cell feed consisting essentially of alkali metal chloride, alkali earth metal chloride and magnesium chloride, to an electrolytic cell producing magnesium, without atmospheric exposure of the molten cell feed; and preparing the molten salt of step (i) by withdrawing at least a part of molten cell salt with reduced content of magnesium chloride, from said electrolytic cell, without atmospheric exposure of the molten cell salt, the molten cell salt comprising the molten salt prepared in step (i).

44. The process according to claim 43, further comprising a step of pretreating said powder by suspending said powder with chlorine gas in molten magnesium chloride so as to remove iron compounds, prior to step (iii).

45. The process according to claim 44, wherein step (i) is performed by adding the alkali metal chloride and alkali earth metal chloride to the molten magnesium chloride, after the pretreating step.

46. The process according to claim 43, further comprising a step of subjecting said cell feed to preliminary electrolysis in a cell at a voltage below the decomposition voltage of magnesium chloride, said cell having an anode chamber and a cathode chamber separated by a porous partition, and said cell feed flowing substantially one-way from the anode chamber to the cathode chamber through said porous partition.

47. The process according to claim 46, wherein the porous partition is made of zirconia, mullite, or silica.

48. The process according to claim 47, wherein the porous partition has pores of not greater than 500 μm in diameter.

49. The process according to claim 46, wherein the porous partition is made of zirconia-mullite or silica-alumina ceramic material.

50. The process according to claim 49, wherein the porous partition has pores of not greater than 200 μm in diameter.

51. The process according to claim 33, wherein the chlorination step is terminated before the magnesium oxide content of said molten salt decreases to 1 wt. % or less.

* * * * *